US007620341B2

(12) United States Patent
Tao

(10) Patent No.: US 7,620,341 B2
(45) Date of Patent: Nov. 17, 2009

(54) IMAGE FORMING DEVICE, IMAGE PRINTING METHOD, AND PROGRAM RECORDING MEDIUM

(75) Inventor: Kozo Tao, Yokohama (JP)

(73) Assignee: Kyocera Mita Corporation (JP)

( * ) Notice: Subject to any disclaimer, the term of this patent is extended or adjusted under 35 U.S.C. 154(b) by 540 days.

(21) Appl. No.: 11/405,824

(22) Filed: Apr. 18, 2006

(65) Prior Publication Data

US 2007/0242999 A1 Oct. 18, 2007

(51) Int. Cl.
*G03G 15/00* (2006.01)

(52) U.S. Cl. ..... 399/82; 399/401; 399/402; 399/407; 399/410

(58) Field of Classification Search ..... 399/402, 399/410, 407, 81, 82, 401
See application file for complete search history.

(56) References Cited

U.S. PATENT DOCUMENTS 5,201,517 A * 4/1993 Stemmle ..... 271/291
5,881,212 A * 3/1999 Morita ..... 358/1.13
6,226,473 B1 * 5/2001 Kutsuwada ..... 399/82

FOREIGN PATENT DOCUMENTS

JP 2000-044109 2/2000
JP 2000-059552 2/2000
JP 2001-235916 8/2001
JP 2003-337508 11/2003

OTHER PUBLICATIONS

Chinese Office Action dated Mar. 28, 2008 and translation thereof in corresponding Chinese application.

* cited by examiner

*Primary Examiner*—Judy Nguyen
*Assistant Examiner*—Matthew G Marini
(74) *Attorney, Agent, or Firm*—Ostrolenk Faber LLP

(57) ABSTRACT

An image forming device having a printing unit, an intermediate tray, and a stapler fixed at a predetermined position, which stacks printed paper printed by the printing unit in the intermediate tray after either a face-down process or a face-up process when performing a normal operation and staples the printed paper when a number of sheets thereof reaches a predetermined number, the image forming device includes: an input unit allowing input of a choice of the face-down process or the face-up process and a choice of one-side printing or two-side printing; and a control unit controlling the image forming device so as to stack the printed paper in the intermediate tray after the printing unit performs two-side printing if a process selected using the input unit is different from one which is performed in the normal operation.

9 Claims, 7 Drawing Sheets

IMAGE FORMING DEVICE, IMAGE PRINTING METHOD, AND PROGRAM RECORDING MEDIUM

BACKGROUND OF THE INVENTION

1. Field of the Invention

The present invention relates to an image forming device which can staple printed documents, a method for printing and a program recording medium.

2. Description of Related Art

FIG. 6 is a schematic diagram showing a conventional image forming device having a stapler, a paper feeding passage thereof, and printed documents being stapled. In FIG. 6, when printing on one side, paper 1 in a paper feeding tray 2 is fed one sheet at a time as symbol (1) shows. Then an image is printed on the paper 1 by an image forming portion 3 constituted by a photosensitive drum or the like as shown by symbol (2). The printed paper 1 is stacked in an intermediate tray 4, pushed to the front in FIG. 6 for aligning its end when a page number reaches a desired number, and stapled by a stapler 5. Finally, a stapled sheaf of paper 6 is discharged in a catch tray 7 as shown by symbol (3).

In this device, printing is performed from the first page of the document in order and the pages stacked in the intermediate tray 4 face-down (hereinbelow, simply referred to as the "face-down process"). Thus the sheaves of paper 6 stapled into a desired number of sheets are stacked in the catch tray 7. The sheaf of paper 6 is stapled at a staple point 8 located at the upper left of the sheaf with respect to the image printed thereon.

When printing on both sides, an image of an odd-numbered page is printed on one side of the paper 1. Then the paper 1 is reversed and an image of an even-numbered page is printed on the other side of the paper 1. The paper both sides of which are printed onto is fed to the intermediate tray 4 and stacked therein face-down.

An image forming device which staples using post-processing equipment has been proposed (see, for example, Japanese Unexamined Patent Application, Publication No. 2000-44109). An image forming device which can move its staple point when printing on one side, by stapling after reversing the paper when it is placed in landscape orientation has been proposed (see, for example, Japanese Unexamined Patent Application, Publication No. 2003-337508). In addition, an image forming device in which it is made possible for assembly and fixing of jams to be performed easily by having a first unit including an intermediate tray and a second unit with a carrying and branching function has also been proposed (see, for example, Japanese Unexamined Patent Application, Publication No. 2001-235916).

In low-cost image forming devices which can perform stapling like the one shown in FIG. 6, only one stapler 5 is provided and it is fixed at a predetermined position. In a case where the stapler 5 is fixed, the staple point 8 on the sheaf of paper 6 is fixed at the upper left thereof with respect to the printed image as shown in FIG. 6. Therefore, the sheaf is stapled at a position which the user does not desire for certain image orientations (portrait or landscape) and feeding directions (short-edge feed or long-edge feed, which will be described later).

For example, in FIG. 7, the staple point 8 is set at the upper left of the paper with respect to the printed image when the image is fed lengthwise (portrait-long edge feed). When the image is fed upside down, the staple point 8 is set at the bottom right of the paper with respect to the printed image as shown in pattern A. In cases where the image is fed at a 90° rotation with respect to the original direction such as in pattern B (portrait-short edge feed) or pattern C (landscape-long edge feed), the staple point 8 is set at the upper right or bottom left of the paper with respect to the printed image. The staple point 8 is set at the upper left or bottom right of the paper with respect to the printed image in pattern D (landscape-short edge feed).

That is, in the cases shown in FIG. 7, the staple point 8 is always fixed on one diagonal line on the paper. In addition, the staple point 8 is set at the upper right or bottom left when the image is fed in a direction perpendicular to the lines of text. Most users generally desire the staple point 8 to be at the upper left of the sheaf of the paper 6 with respect to the image printed thereon. Accordingly, there is a problem in that a document cannot be stapled at a desired position in image feeding conditions like pattern B or pattern C shown in FIG. 7. Rotating the paper so that it is at a 90° rotation is a possible solution to this problem. However, this problem cannot be avoided in a case where paper of a large size such as A3 paper is used because such large sized paper cannot be turned.

SUMMARY OF THE INVENTION

An object of the present invention is to control an image forming device so as to set a staple point at the upper left of printed paper with respect to a printed image even when paper is fed as in pattern B or in pattern C in FIG. 7.

A first aspect of the present invention is an image forming device having a printing unit, an intermediate tray, and a stapler fixed at a predetermined position, which stacks printed paper printed by the printing unit in the intermediate tray after either a face-down process or a face-up process (a process in which the printed paper is stacked in the intermediate tray face-up) when performing a normal operation and staples the printed paper when a number of sheets thereof reaches a predetermined number, the image forming device comprising: an input unit adapted to allow input of a choice of the face-down process or the face-up process and a choice of one-side printing or two-side printing; and a control unit which controls the image forming device so as to stack the printed paper in the intermediate tray after the printing unit performs two-side printing if a process selected using the input unit is different from one which is performed in the normal operation.

The control unit may control the printing unit so as to perform two-side printing, printing blank data on one side of the paper when one-side printing is selected using the input unit.

A second aspect of the present invention is a recording medium on which is recorded a program applicable to an image forming device having a printing unit, an intermediate tray, and a stapler fixed at a predetermined position, which stacks printed paper printed by the printing unit in the intermediate tray after either a face-down process or face-up process when performing a normal operation and staples the printed paper when a number of sheets thereof reaches a predetermined number, wherein the program comprises: a first step of receiving input of a choice of the face-down process or the face-up process and a choice of one-side printing or two-side printing; a second step of controlling the printing unit so as to perform two-side printing if a process chosen in the first step is different from one which is performed in the normal operation; and a third step of controlling the image forming device so as to stack the printed paper in the intermediate tray.

In the second step, the printing unit may be controlled so as to perform two-side printing, printing blank data on one side of the paper when one-side printing is selected in the first step.

A third aspect of the present invention is a method for image printing applicable to an image forming device having a printing unit, an intermediate tray, and a stapler fixed at a predetermined position, which stacks printed paper printed by the printing unit in the intermediate tray after either a face-down process or a face-up process when performing a normal operation and staples the printed paper when a number of sheets thereof reaches a predetermined number, the method for image printing comprising: a first step of receiving input of a choice of the face-down process or the face-up process and a choice of one-side printing or two-side printing; a second step of controlling the printing unit so as to perform two-side printing if a process chosen in the first step is different from one which is performed in the normal operation; and a third step of controlling the image forming device so as to stack the printed paper in the intermediate tray.

In the second step, the printing unit may be controlled so as to perform two-side printing, printing blank data on one side of the paper when one-side printing is selected in the first step.

DETAILED DESCRIPTION OF THE INVENTION

Figure 1:
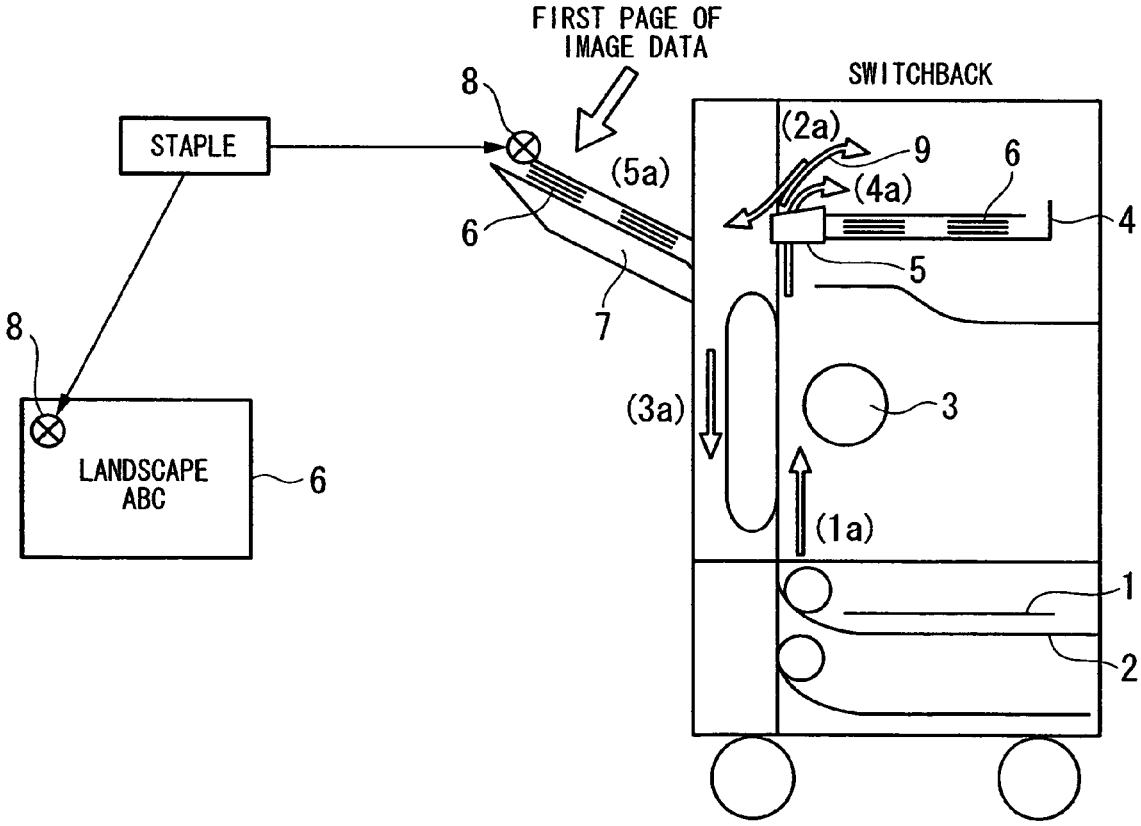
FIG. 1 is a schematic diagram showing a paper feeding passage of an image forming device according to an embodiment of the present invention and a sheaf of printed paper.
Figure 6:
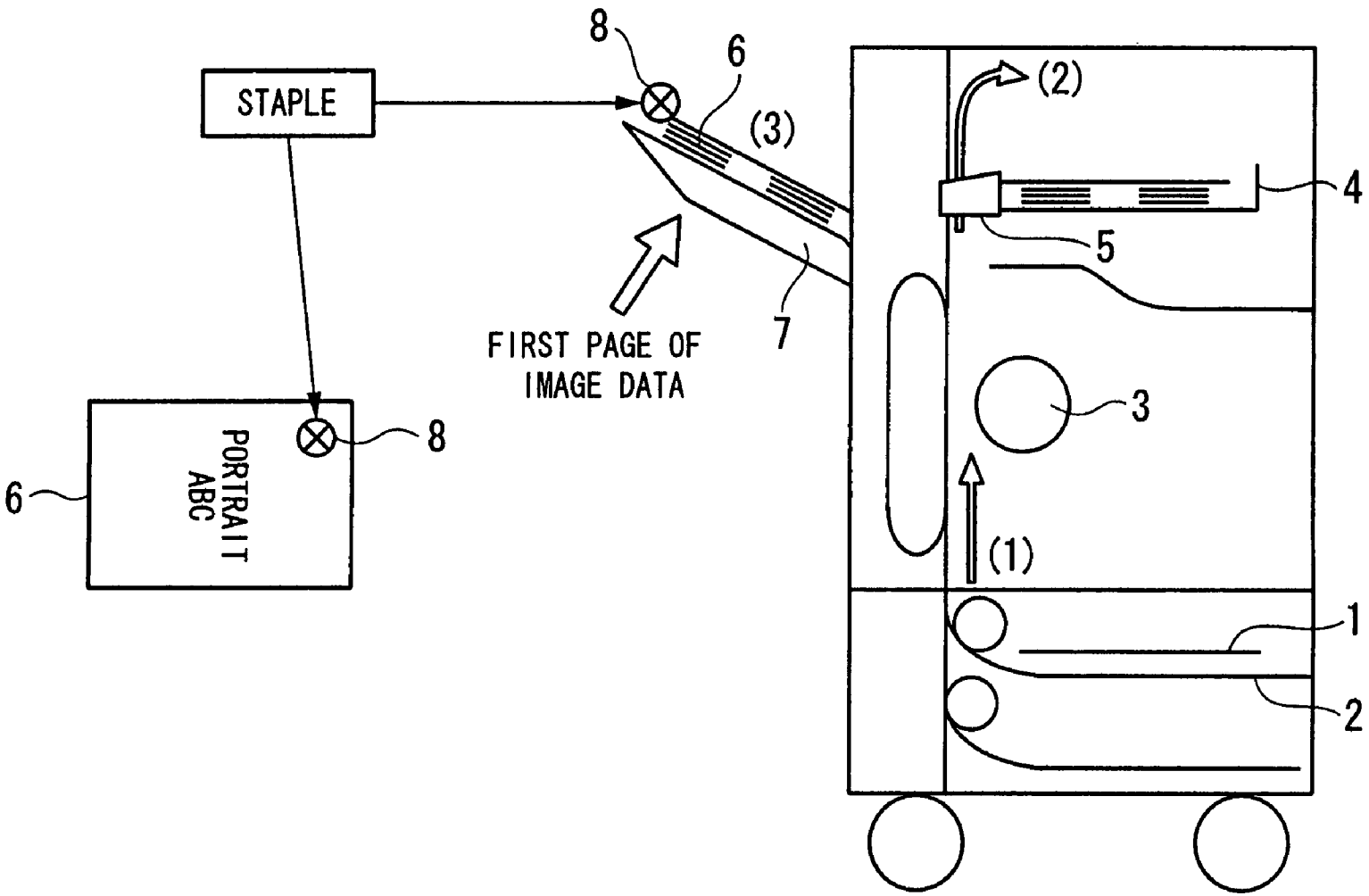
FIG. 6 is a schematic diagram showing a paper feeding passage of a conventional image forming device and a sheaf of printed paper.
Figure 7:
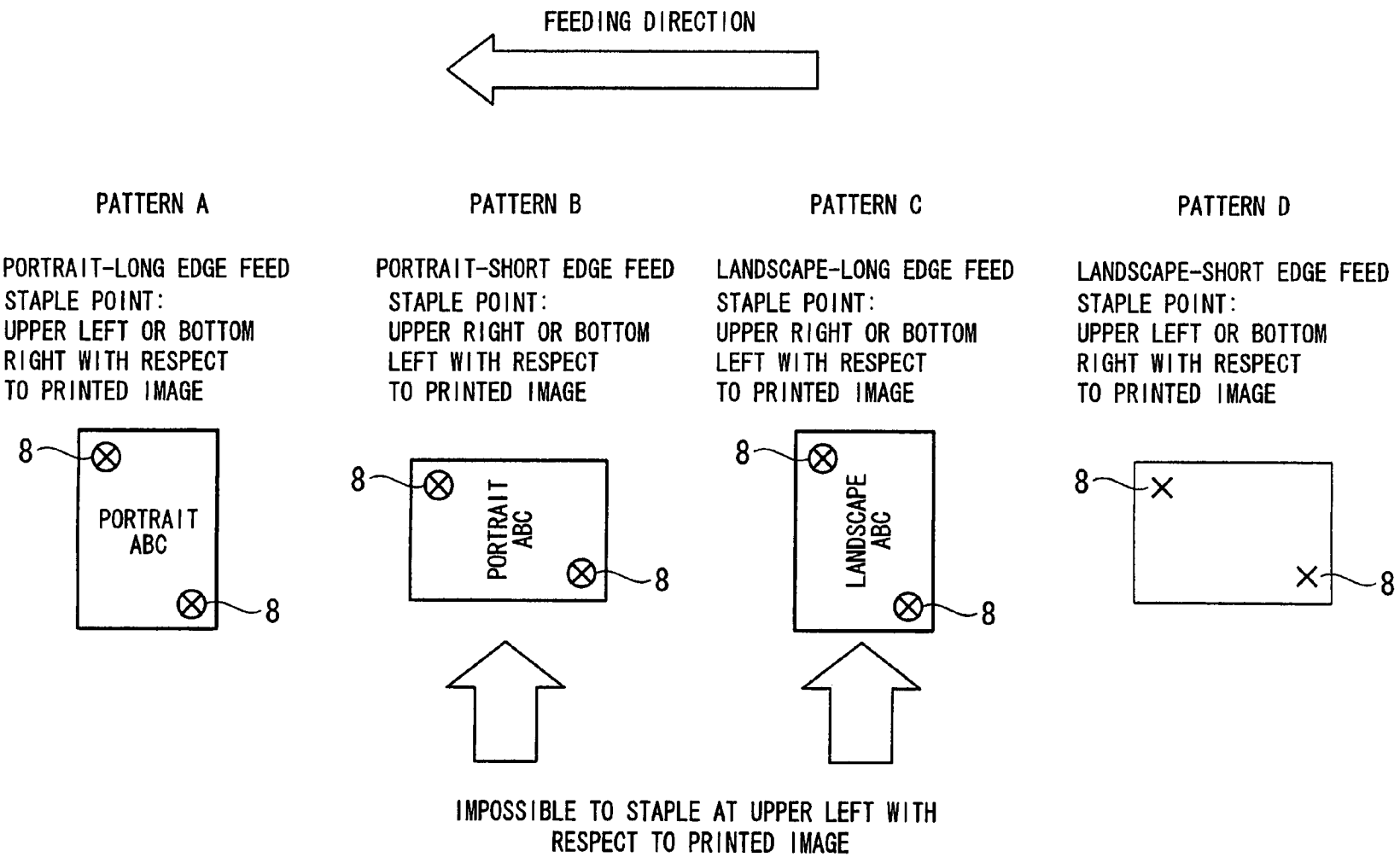
FIG. 7 is a diagram showing staple points in several patterns of different feeding directions and shapes of images.

An embodiment of the present invention is described below with reference to the drawings. FIG. 1 is a schematic diagram showing a paper feeding passage of an image forming device with a stapler according to an embodiment of the present invention and a sheaf 6 of printed paper. In FIG. 1, components identical to those in FIG. 6 are referred to using the same reference numerals and redundant descriptions are omitted. FIG. 1 shows a case of landscape-long edge feed, which is referred to as pattern C in FIG. 7.

Figure 2:
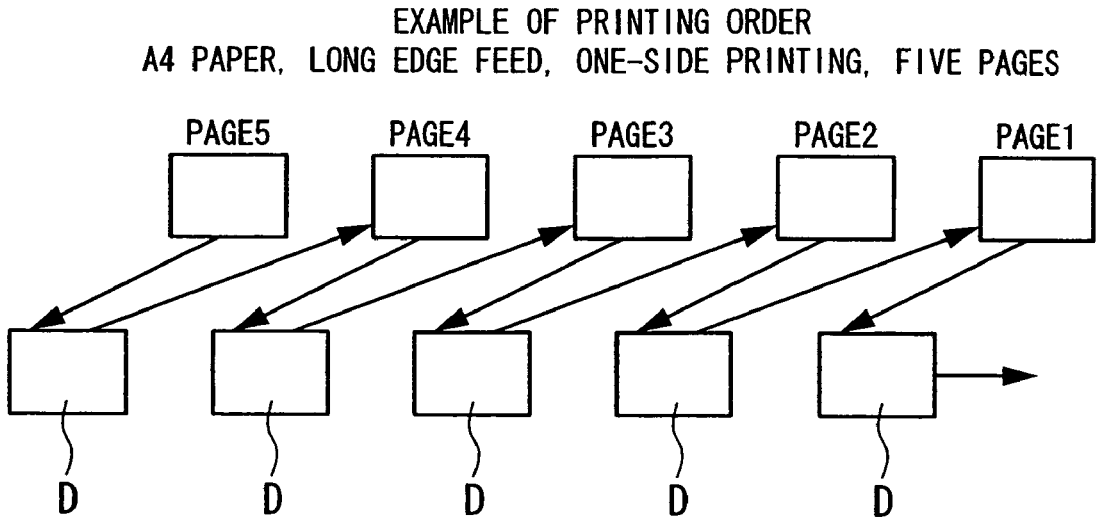
FIG. 2 is a diagram showing a change of printing order of image data when performing one-side printing.
Figure 3:
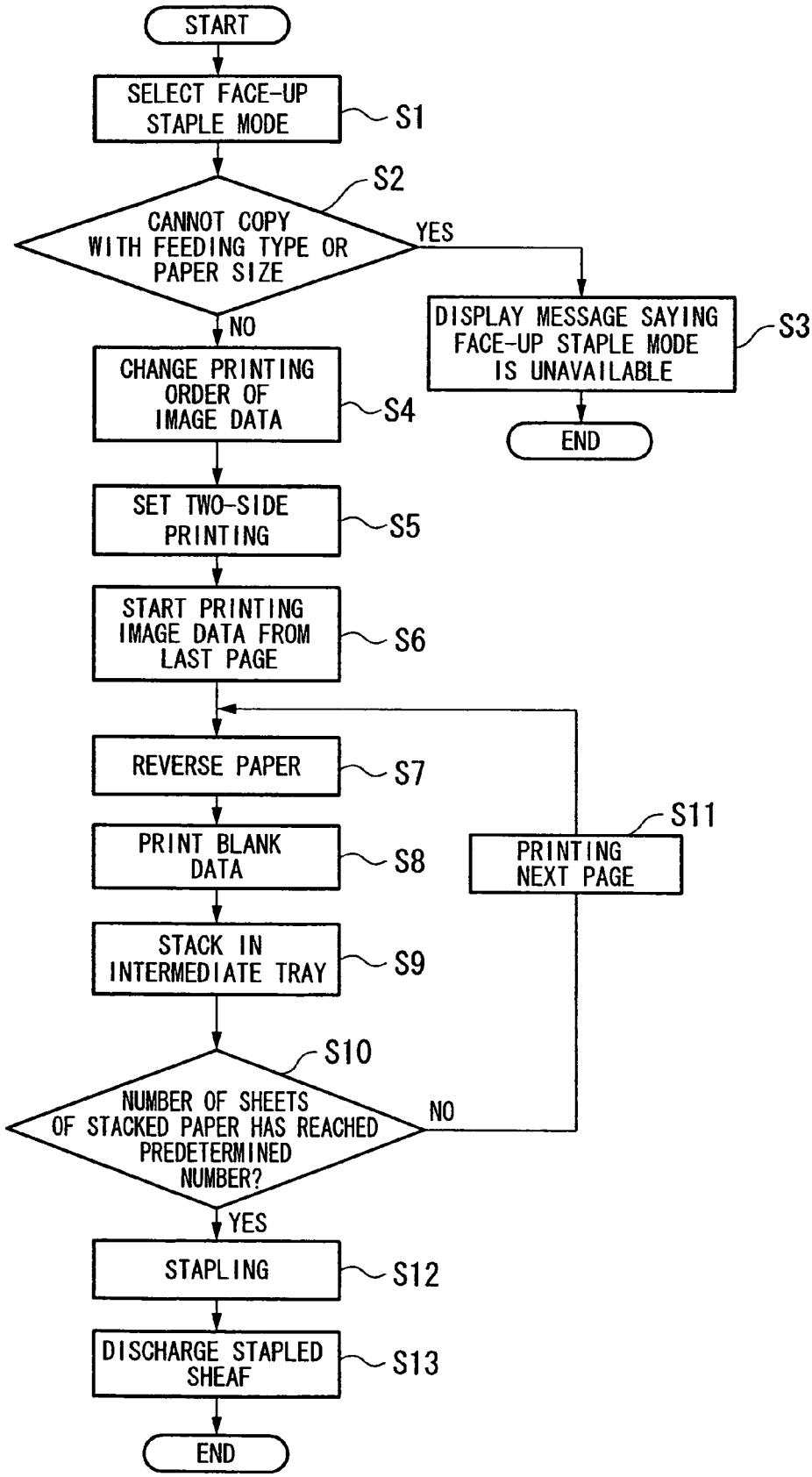
FIG. 3 is a flowchart showing operation in one-side printing.

This embodiment performs printing from the last page of images and performs a face-up process in which printed paper is stacked in the intermediate tray 4 face-up in order to set the staple point 8 at the upper left of the sheaf 6 with respect to the printed image. When performing the face-up process, the paper 1 on which the image is printed by the image forming portion 3 is fed to the intermediate tray 4 after being reversed at a switchback unit 9 which is used in conventional image forming devices in order to perform two-side printing. When the paper 1 stacked in the intermediate tray 4 reaches a predetermined number of sheets, the sheaf 6 is stapled by the stapler 5 and discharged to the catch tray 7. Thus the sheaves 6 of the predetermined number of sheets are stapled and stacked on the catch tray 7 face up. In this case, the staple point 8 is always located at the upper left of the sheaf 6 with respect to the printed image, as shown in FIG. 1. FIG. 2 shows operation of printing five-page image data with one-side printing and landscape-long edge feed. FIG. 3 is a flowchart showing operation in the situation shown in FIG. 2.

In FIG. 3, a user sets "face-up staple mode" to set the staple point 8 at the upper left of the sheaf 6 with respect to the printed image when performing one-side printing and landscape-long edge feed (pattern C in FIG. 7) is performed (step S1). If the size, type, and feeding tray of the paper render copying impossible (YES in step S2), the face-up staple mode is determined to be unavailable. The image forming device displays a message indicating the face-up staple mode cannot be used (step S3) and terminates the process.

If copying is possible under the conditions set, the printing order of the image data to be printed is changed as shown in FIG. 2 (step S4). Specifically, the printing of the image data is performed from page 5, then page 4, page 3, page 2, and page 1 in order. Dummy blank datum D is inserted after each page of the image data. Then, two-side printing is set as the type of printing to perform (step S5) although the user has selected one-side printing in this case.

Next, the paper 1 is fed from the feeding tray 2 as shown by symbol (1*a*) in FIG. 1 and printing is started from the last page (here, page 5) (step S6). Five sheets of paper printed by the image forming portion 3 are reversed at the switchback unit 9 as shown by symbol (2*a*) in FIG. 1, and are fed back through another feeding passage as shown by symbol (3*a*). Then the paper passes through the image forming portion 3 again and blank datum is printed on the other side thereof (step S8). That is, the paper just passes through the image forming portion 3 without being printed on.

The printed paper is fed to the intermediate tray 4 face-up (step S9). Then it is determined whether a number of sheets of the printed paper has reached a predetermined number (e.g., five sheets) (step S10). If it is determined that the number of sheets of the printed paper has not reached the predetermined number, the next page of the image data is printed (step S11).

Steps S7 to S11 are repeated until the number of sheets of the printed paper reaches the predetermined number. When the last printed page (in this case, page 1) of the predetermined number has been stacked in the intermediate tray 4, the sheaf 6 of the printed paper is stapled by the stapler 5 (step S12), and is stacked on the catch tray 7 face-up (step S13). Through these processes, the five-sheet sheaf 6 of paper, being stacked in order of page 1, page 2, page 3, page 4, and page 5 and with the staple point 8 set at the upper left of the paper with respect to the printed image, can be obtained.

Figure 4:
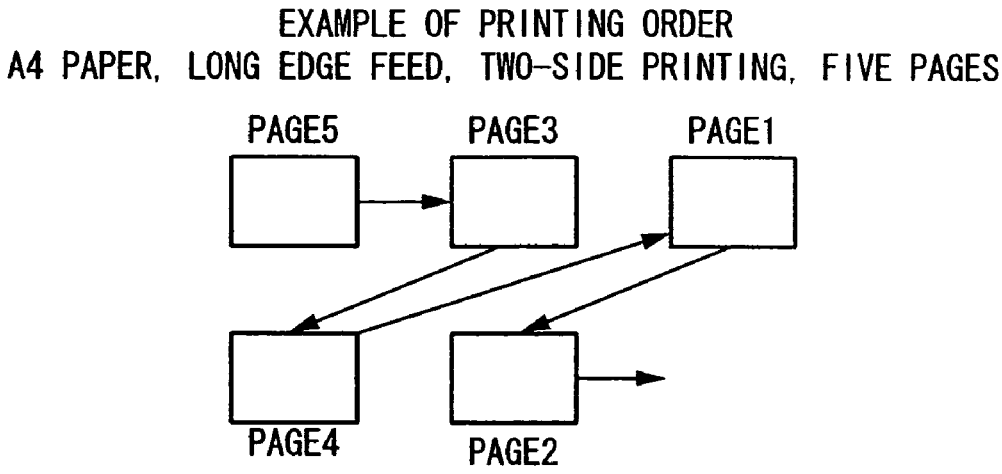
FIG. 4 is a diagram showing a change of printing order of image data when performing two-side printing.

FIG. 4 shows each page in an operation of printing five-page image data with two-side printing and landscape-long edge feed.

In the operation shown in FIG. 4, the paper is reversed and stacked in the intermediate tray 4 face-up after the last page (in this case, page 5) has been printed. Then page 3 is printed on the next sheet of paper. The next sheet of paper is reversed and page 4 is printed on the other side. The next sheet of paper is stacked in the intermediate tray 4, with page 3 up. Then page 1 is printed on the third sheet of paper. The third sheet of paper is reversed and page 2 is printed on the other side. The third sheet of paper is stacked in the intermediate tray 4, with page 1 up. Through these processes, the three-sheet sheaf 6 of paper, being stacked in order of page 1 (with page 2 printed on the other side), page 3 (with page 4 printed on the other side), and page 5 with the staple point 8 set at the upper left of the paper with respect to the printed image, can be obtained.

In the operations shown in FIGS. 2 and 4, when image data of more than five pages (e.g., 20 pages) are printed and the printed paper is stapled into five-sheet sheaves, printing is performed from page 20. Thus the printed paper is stapled into five-sheet sheaves 6 and stacked successively.

As described above, the face-up staple mode of the present embodiment is one in which face-up staple processing is performed by always performing two-side printing even if the user chooses one-side printing, and by starting printing from the last page of the image data to be printed. On the other hand, the conventional image forming device shown in FIG. 6 starts printing from the first page of image data to be printed and performs stapling after a face-down process. Therefore, the present embodiment can be realized by the aforementioned conventional image forming device without additional components, if it is controlled to always perform two-side printing even if the user chooses one-side printing, and to start printing from the last page of image data to be printed while performing a face-down process. The present embodiment can be applied to conventional image forming devices with few changes because the operations required of the conventional image forming device are substantially identical to the operations performed when two-side printing is carried out. Although an example is given above for when the present embodiment is applied to a conventional image forming device which performs a face-down process in normal operation, the present embodiment can be also applied to image forming devices which perform a face-up process in normal operation. In this case, the image forming device should be controlled to always perform two-side printing even if the user chooses one-side printing, and to start printing from the first page of the image data to be printed.

Figure 5:
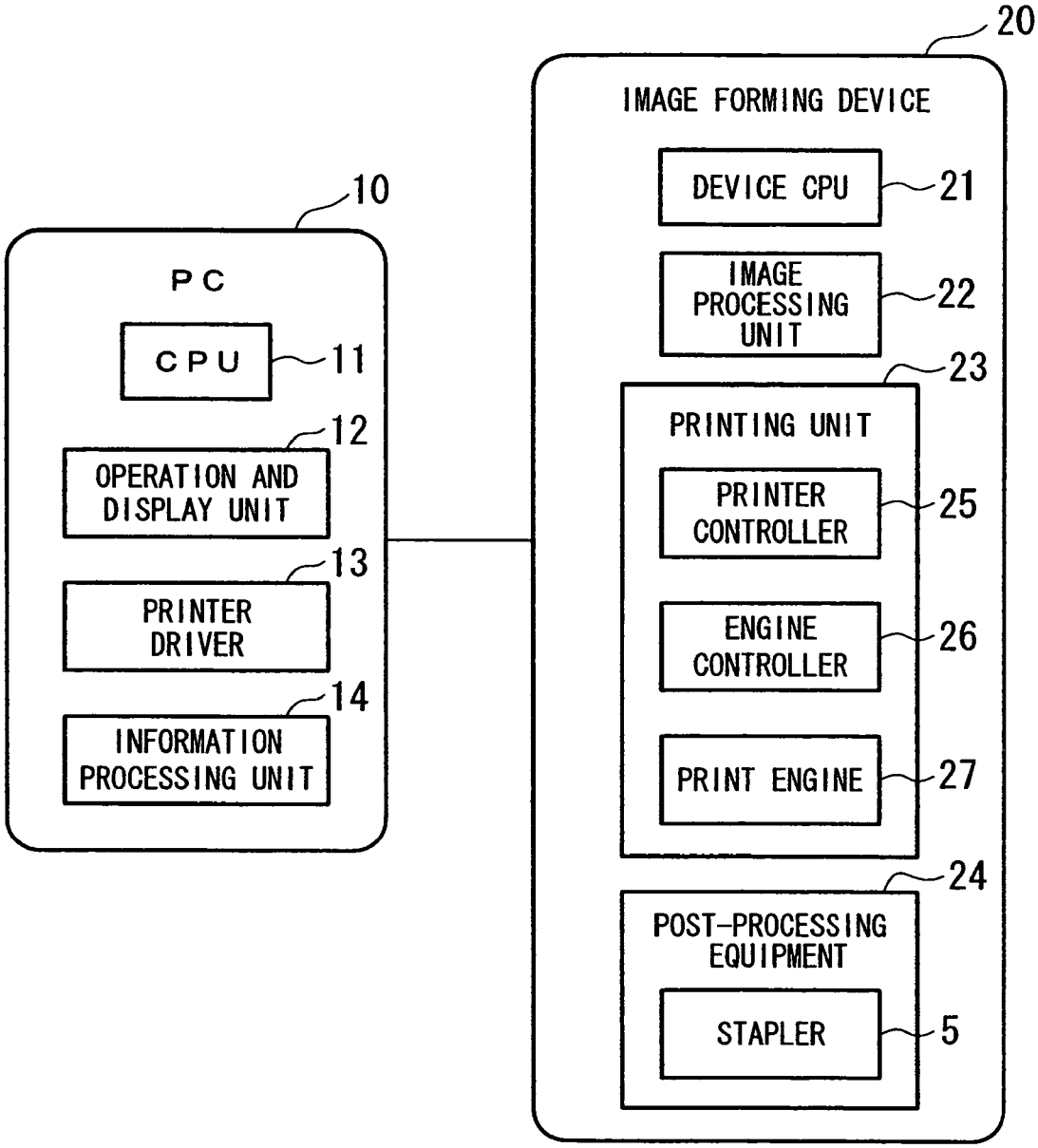
FIG. 5 is a block diagram showing an image forming device according to an embodiment of the present invention.

FIG. 5 is a block diagram showing an image forming system including an image forming device for the aforementioned printing method.

A personal computer (PC) 10, a host computer, has a central processing unit (CPU) 11, an operation and display unit 12 for operations including selecting the face-up staple mode and display thereof, a printer driver 13, and an information processing unit 14. An image forming device 20 has a device CPU 21 which controls the whole image forming device, an image processing unit 22, a printing unit 23, and post-processing equipment 24 having a stapler 5. The printing unit 23 has a printer controller 25, an engine controller 26, and a print engine 27. The post-processing equipment 24 may be removable from the image forming device 20 itself.

In the system of the aforementioned constitution, the change of printing order of image data to be printed shown in FIGS. 2 and 4 may be performed by the printer driver 13 in the PC 10, and the image data may be sent to the printing unit 23 from the last page. In this case, when the face-up staple mode is selected using the PC 10 and a command to use face-up staple mode is received by the device CPU 21 of the image forming device 20, the device CPU 21 controls the image forming device 20 so as to perform the face-down process, the same as in a conventional case, and to change the printing order of the image data, always performing two-side printing, when conditions allow for the face-up staple mode. The face-up staple mode thus can be performed.

The change of printing order of image data may be performed by the printer controller 25. In this case, the printing order is changed after all pages of the image data are saved in a memory device in the image forming device 20. Operation in the face-up staple mode may be performed by the engine controller 26. In this case, the engine controller 26 can handle the face-down stapling process. Insertion and changing the printing order of the blank data may be performed by a combination of the printer driver 13 and the printer controller 25, the printer controller 25 only, or the engine controller 26.

A program for carrying out a printing method of the present embodiment and a program recording medium on which the program is recorded are described below.

A program for the device CPU 21 in the computer system of the image forming device 20 according to an embodiment of the present invention to control the image forming device 20 so as to perform the aforementioned operations and the processing shown in the flowchart of FIG. 3 corresponds to a program according to the present invention.

A magnetooptical disc, an optical disc, semiconductor memory, or a magnetic recording medium may be used to record the program and these recording media may be in the form of read only memory (ROM), random access memory (RAM), a CD-ROM, a flexible disc, a memory card, or the like. A recording medium which maintains the program for a certain period of time like volatile memory such as a RAM in a computer system used as a server or a client when the program is sent via a network or telecommunication lines such as phone lines is also included among the aforementioned recording media.

The program may be one sent from a computer system which saves the program in a memory device or the like to another computer system via a transmission medium or by a transmitted wave in the transmission medium. The phrase "transmission medium" means a medium which has a function of transmitting information such as the Internet (a communication network) or telecommunication lines such as phone lines (communication lines). The program may be one for performing a part of the aforementioned functions. The program may be a differential file (differential program) which enables the computer system to perform the aforementioned function in combination with a program recorded on the computer system.

Accordingly, the program or the recording medium on which the program is recorded may be located in a system or a device different from the system or the device shown in FIGS. 1 and 5. In this case as well, identical functions and effects to those of the system or device of the aforementioned embodiment can be obtained when the system or device of the present invention executes the program located in the different system or the different device. Thus the objects of the present invention can be accomplished.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An image forming device having as a first mode a paper stacking operation in a first mode-facing direction selected from a group consisting of a face-up process and a face-down process, the image forming device comprising:

a printing unit operable to print on a plurality of pieces of paper data for a plurality of pages;

an intermediate tray operable to support a stack of the plurality of pieces of paper;

a stapler positioned at a predetermined position;

an input unit operable to receive user input indicating, as a paper facing choice, one of the face-down process or the face-up process and a choice of one-sided printing or two-sided printing; and a control unit operable to control the image forming device so as to stack the plurality of pieces of paper in a predetermined order by the printing unit in the intermediate tray when performing either of the face-down process and the face-up process, to staple the plurality of pieces of paper at the predetermined position to create a sheaf, and to discharge the sheaf, wherein the control unit controls the image forming device so as to perform two-sided printing regardless of the user input received by the input unit and to reverse the predetermined order of the stacking, when user input indicated as the paper facing choice indicates the other-facing direction from the first mode-facing direction.

2. The image forming device according to claim 1, wherein the control unit controls the printing unit so as to perform two-sided printing and to insert blank data for one page between each page of the data when the other of the face-down process and the face-up process and the one-sided printing are selected using the input unit.

3. The image forming device according to claim 1, wherein the sheaf is discharged stapled side first.

4. A computer readable recording medium on which is recorded a computer readable program including instructions for controlling an image forming device having a printing unit, an intermediate tray, and a stapler fixed at a predetermined position, the image forming device operable to stack in the intermediate tray a plurality of pieces of paper on which data for a plurality of pages is printed in a predetermined order by the printing unit and having as a first mode a paper stacking operation in a first mode-facing direction selected from a group consisting of a face-up process and a face-down process, the program comprising:

instructions to control receiving, as a paper facing choice, input of a user choice of one of the face-down process, or the face-up process, and a choice of one-sided printing or two-sided printing;

instructions to control the printing unit so as to perform the two-sided printing regardless of the input of the user choice and so as to reverse the predetermined order of the stacking, when user input indicated as the paper facing choice is the other-facing direction from the first mode-facing direction;

instructions to control the image forming device so as to stack the plurality of pieces of paper in the intermediate tray;

instructions to control stapling the plurality of pieces of paper at the predetermined position to create a sheaf; and instructions to control discharging the sheaf.

5. The computer readable recording medium according to claim 4, wherein the instructions to control the printing unit control the printing unit to perform two-sided printing, and to insert blank data for one page between each page of the data when the other of the face-down process and the face-up process and the one-sided printing are selected in the first step.

6. The computer readable program recording medium according to claim 4, wherein when the sheaf is discharged, the sheaf is discharged stapled side first.

7. A method for image printing applicable to an image forming device having a printing unit, an intermediate tray, and a stapler fixed at a predetermined position, the image forming device operable to stack in the intermediate tray a plurality of pieces of paper on which data for a plurality of pages is printed and having as a first mode a paper stacking operation in a first mode-facing direction selected from a group consisting of a face-up process and a face-down process, the method for image printing comprising:

a first step of receiving input of a user choice of one of the face-down process or the face-up process and a choice of one-sided printing or two-sided printing;

a second step of controlling the printing unit so as to perform the two-sided printing regardless of the input in the first step and so as to reverse the predetermined stacking order, when user input indicated as the paper facing choice is the other-facing direction from the first mode-facing direction;

a third step of controlling the image forming device so as to stack the plurality of pieces of paper in the intermediate tray;

a fourth step of controlling the image forming device so as to staple the plurality of pieces of paper at the predetermined position to create a sheaf; and a fifth step of controlling the image forming device so as to discharge the sheaf.

8. The method image printing according to claim 7, wherein in the second step, the printing unit is controlled so as to perform two-sided printing, and to insert blank data for one page between each page of the data when the other of the face-down process and the face-up process and the one-sided printing are selected in the first step.

9. The method for image printing according to claim 7, wherein in the fifth step the sheaf is discharged stapled side first.

* * * * *